US008297482B2

(12) United States Patent
Hill

(10) Patent No.: US 8,297,482 B2
(45) Date of Patent: Oct. 30, 2012

(54) MANIFOLD AND NOZZLE CLOSURE/SEAL SYSTEM

(75) Inventor: Brian Hill, Des Plaines, IL (US)

(73) Assignee: Fluid Management Operations LCC, Wheeling, IL (US)

( * ) Notice: Subject to any disclaimer, the term of this patent is extended or adjusted under 35 U.S.C. 154(b) by 389 days.

(21) Appl. No.: 12/623,531

(22) Filed: Nov. 23, 2009

(65) Prior Publication Data

US 2011/0122196 A1 May 26, 2011

(51) Int. Cl.
*B65D 5/72* (2006.01)

(52) U.S. Cl. ..... 222/490; 222/542

(58) Field of Classification Search ..... 222/490, 222/571, 485, 478, 108, 542, 551, 545, 546, 222/566, 480, 482, 481.5
See application file for complete search history.

(56) References Cited

U.S. PATENT DOCUMENTS 5,598,940 A * 2/1997 Finkelstein et al. ..... 215/348
8,181,827 B2 * 5/2012 Long et al. ..... 222/189.02

* cited by examiner

*Primary Examiner* — Lien Ngo
(74) *Attorney, Agent, or Firm* — Miller, Matthias & Hull LLP

(57) ABSTRACT

A combination manifold and nozzle closure system is disclosed. The closure system limits exposure of the nozzle outlets to air between dispenses or between uses. Manifold accommodates a plurality of nozzles. Each nozzle includes a nozzle outlet extending beyond an end of the manifold. An actuator shaft passes through the manifold and is connected to a plate at its distal end with a film disposed between the plate and the nozzle outlets. An actuator moves the actuator shaft from a closed position where the film engages the nozzle outlets and the plate is disposed just below the nozzles to an open position where the film and plate have been pulled upward beyond the nozzle outlets. The plate includes a plurality of openings and the film includes a plurality of valves each opening in the plate is in alignment with a valve and each valve is in alignment with one of the nozzle outlets. By moving the plate and film upward past the nozzle outlets, the valves and the film open and the nozzle outlets extend through the openings in the plate and are therefore free to dispense. To close the system, the actuator moves the shaft, plate and film downward where the valves and the film close and engage the nozzle outlets to keep the nozzle outlets relatively isolated from air between dispenses.

11 Claims, 4 Drawing Sheets

MANIFOLD AND NOZZLE CLOSURE/SEAL SYSTEM

BACKGROUND

1. Technical Field

An apparatus is disclosed for dispensing fluids through individual nozzles mounted in a common manifold or nozzle block. The apparatus includes an improved closure system which, in a closed position, provides a cover and a seal for the nozzles to prevent dried material from clogging the nozzles. The closure system is particularly useful for dispensers of viscous, water-based fluids including, but not limited to, paint colorants.

2. Description of the Related Art

Systems for dispensing a plurality of different fluids into a container are known. For example, systems for dispensing paint base materials and colorants into a paint container are known. These paint dispensers may use twenty or more different colorants to formulate a paint mixture. Each colorant is contained in a separate canister or package and may include its own dispensing pump. Other systems for dispensing large varieties of different fluids also include systems for dispensing pharmaceutical products, hair dye formulas, cosmetics of all kinds, nail polish, etc.

Some systems for use in preparing products at a point of sale may use a stationary manifold or nozzle block through which pluralities of nozzles extend. Each fluid to be dispensed is then pumped through its own individual nozzle that is accommodated in the manifold. Depending upon the size of the container and the quantity of the fluids to be dispensed, manifolds may be designed in a space efficient manner so that a single manifold can accommodate twenty or more different nozzles. The nozzles are connected to the various fluids by flexible hoses and the ingredients are contained in stationary canisters or containers.

In many fluid dispensing applications, precision is essential as many formulations require the addition of precise or nearly exact amounts of certain ingredients. This is not only true in the pharmaceutical industry but also in the paint and cosmetic industries as the addition of more or less tint or colorant can result in a visible change in the color of the resulting product.

Precision dispensing of viscous fluids can be particularly problematic. Specifically, viscous fluids such as tints, colorants, base materials for cosmetic products, certain pharmaceutical ingredients or other viscous fluid materials have a tendency to dry and cake onto the end of the nozzles or inside the nozzle outlet openings. As a result, the nozzles may require frequent cleaning in order for the nozzles to operate accurately. The accumulation of material on or in the nozzle can cause a drop of fluid to stick to the nozzle, thereby compromising the accuracy of the dispense. While some mechanical wiping or scrapping devices are available, these devices are not practical for multiple nozzle manifold systems and the scraper or wiper element must be manually cleaned anyway. Further, cleaning of a multiple nozzle manifold can cause cross-contamination between the nozzles, which also affects accuracy of the dispense.

The drying or taking of material inside or on the nozzles is exacerbated by modern air quality requirements, which limit the use of volatile organic compounds (VOCs) as solvents. Simply put, many water-based viscous fluids dry out faster than their VOC-based counterparts. This is particularly true with paint colorants.

One solution provided in commonly assigned U.S. Pat. No. 7,261,131 is a mechanized cup-shaped closure element that covers and seals from beneath the manifold after the dispensing operation is complete. In this manner, the viscous materials being dispensed through the nozzles have less exposure to air thereby requiring a lower frequency of cleaning operations. However, while the cup-shaped closure element of U.S. Pat. No. 7,261,131 forms a sealed chamber beneath the nozzles, the amount of air in the chamber can still lead to unwanted drying and caking of material on the nozzles.

SUMMARY OF THE DISCLOSURE

A combination manifold that accommodates a plurality of nozzles and a closure system for limiting exposure of the nozzles to air between uses is disclosed. The disclosed combination comprises a manifold comprising an inlet end and an outlet end. The manifold also includes a plurality of through openings extending between the inlet and outlet ends. The through openings accommodate a plurality of nozzles. Each nozzle comprises a nozzle outlet extending beyond the outlet end of the manifold. The combination also comprises an actuator shaft that comprises a proximal end connected to an actuator and a distal end connected to a plate. The plate is coupled to a film disposed between the plate and the nozzle outlets. The plate comprises a plurality of through openings with each through opening of the plate being in matching registry with one of the nozzles. The film also comprises a plurality of valves. Each valve is in matching registry with one of the nozzles.

In a refinement, the valves in the film are small slits. In another refinement, the valves in the film a small crossing slits or x-shaped slit patterns.

In another refinement, the valves in the film are small holes that expand and stretch over the nozzle outlets when the actuator moves the plate and film upward over the nozzle outlets.

In another refinement, the film comprises a material selected from the group consisting of polyurethanes, polytetrafluoroethylene, modified polytetrafluoroethylene, ethylene-propylene copolymers, ethylene-propylene terpolymers, silicone elastomers, polyoxymethylenes, polyacetyls, polyamides, polyethylenes, polypropylenes, nitrile rubbers, tetrafluoroethylene-propylene rubbers, hydrogenated nitrile butadiene rubbers and combinations thereof.

In a refinement, the film comprises multiple layers. In a related refinement, the film comprises multiple polymer layers.

In another refinement, the actuator moves the shaft between open and closed positions. In the open position, the film is sandwiched between the plate and the outlet end of the manifold with the nozzle outlets extending at least partially through the valves of the film and at least partially through the through openings of the plate. In a closed position, the plate and film are moved away from the outlet end of the manifold so the valves of the film close and engage the nozzle outlets.

In another refinement, the plate is rigid and the film is flexible.

In another refinement, the actuator shaft passes through a common access of the plate, film and manifold.

In another refinement, the plate is metallic and the film is polymeric.

A dispenser for dispensing a plurality of fluids is also disclosed. The dispenser comprises a manifold comprising an inlet end and an outlet end. The manifold includes a plurality of openings extending between the inlet and outlet ends. The openings each accommodate a nozzle with each nozzle being linked to a fluid supply. Each nozzle comprises a nozzle outlet extending beyond the outlet end of the manifold. An actuator shaft passes through the manifold and is connected to an actuator at a proximal end and to a plate at a distal end. The actuator shaft passes through a film disposed between the plate and the nozzle outlets. The actuator shaft and actuator move the plate and film between open and closed positions. The plate comprises a plurality of through openings with each opening being in matching registry with one of the nozzles. The film comprises a plurality of valves, with each valve being in matching registry with one of the nozzles. When the actuator moves the actuator shaft to an open position, the film is sandwiched between the plate and the outlet end of the manifold with the nozzle outlets extending at least partially through the valves of the film and at least partially through the openings of the plate. When the actuator moves the actuator shaft to a closed position, the plate and film are moved away from the outlet end of the manifold so that the valves of the film close and rest against the nozzle outlets. The closed valves of the film, in combination with the nature of the film serve to provide a closure or seal against the nozzle outlets, thereby preventing material from drying out and clogging the nozzle outlets.

A method of dispensing viscous, water based fluids is also disclosed wherein the fluids are dispensed through a common manifold. The method comprises providing a fluid dispenser comprising a manifold, comprising and inlet end and an outlet end. The manifold also includes a plurality of openings, each of which accommodates a nozzle. Each nozzle is linked to a fluid supply and each nozzle outlet extends beyond the outlet end of the manifold. An actuator shaft passes through the manifold and is connected to an actuator at one end and to a rigid plate at the other end. The actuator shaft also passes through a film disposed between the plate and the nozzle outlets. The plate includes a plurality of openings, with each opening being in matching registry with one of the nozzles and, similarly, the film comprises a plurality of valves, with each valve being in matching registry with one of the nozzles and in matching registry with the openings of the plate. The method includes the step of moving the actuator shaft to an open position where the film is sandwiched between the plate and the outlet end of the manifold and the nozzle outlets extend at least partially through the valves of the film and at least partially through the openings of the plate. The method further includes dispensing one or more fluids through the nozzles when the actuator and shaft are in the open position. The method further includes moving the actuator and actuator shaft to a closed position resulting in moving of the plate and film from the outlet end of the manifold to the nozzle outlets so the valves of the film close and rest against the nozzle outlets and provide a seal at the nozzle outlets between dispenses.

Other advantages and features will be apparent from the following detailed description when read in conjunction with the attached drawings.

BRIEF DESCRIPTION OF THE DRAWINGS

For a more complete understanding of the disclosed methods and apparatuses, reference should be made to the embodiments illustrated in greater detail in the accompanying drawings, wherein.

It should be understood that the drawings are not necessarily to scale and that the disclosed embodiments are sometimes illustrated diagrammatically and in partial views. In certain instances, details which are not necessary for an understanding of the disclosed methods and apparatuses or which render other details difficult to perceive may have been omitted. It should be understood, of course, that this disclosure is not limited to the particular embodiments illustrated herein.

DETAILED DESCRIPTION OF THE PRESENTLY PREFERRED EMBODIMENTS

Figure 1:
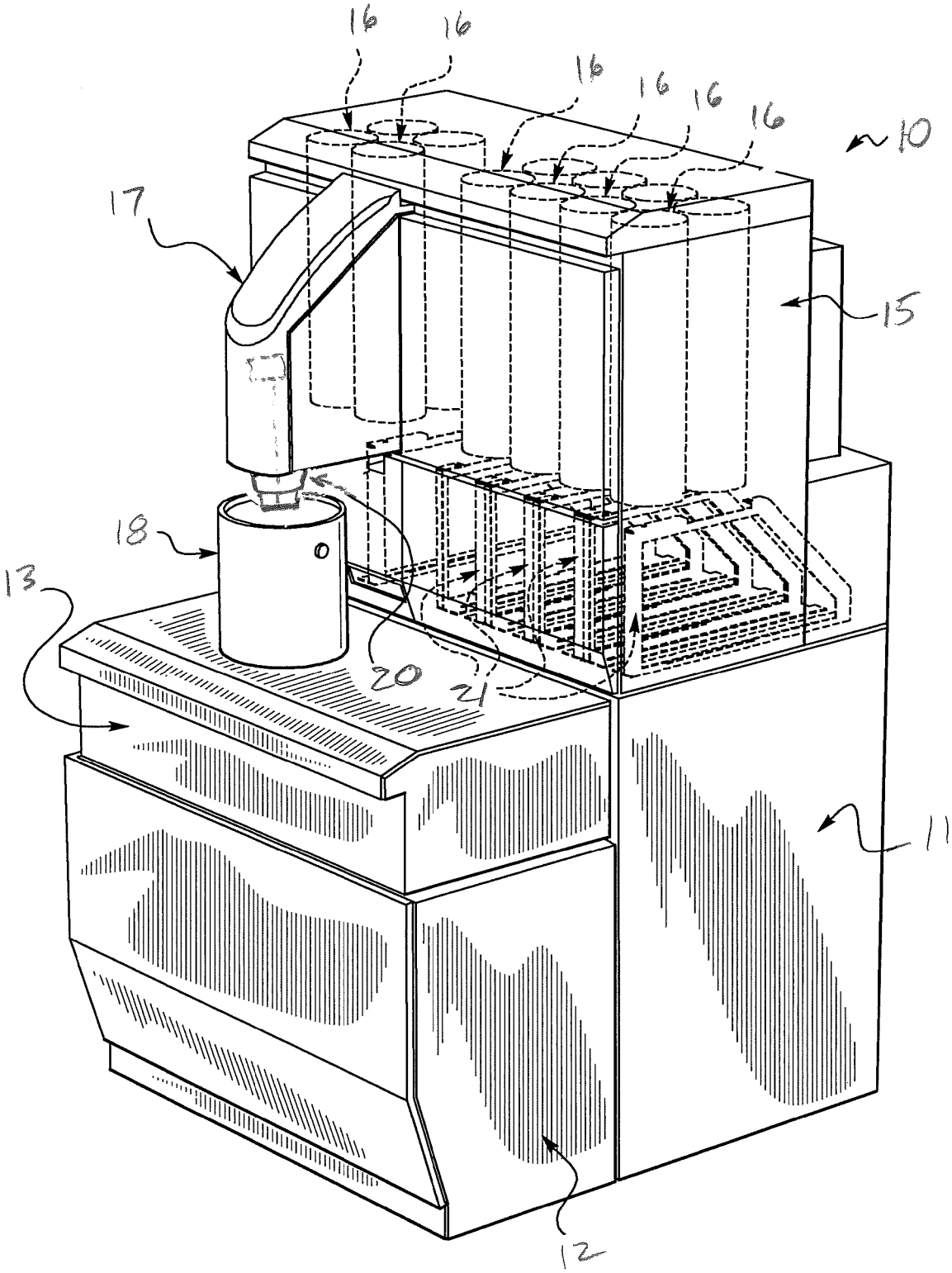
FIG. 1 is a perspective view of a multiple fluid dispensing system made in accordance with this disclosure.

FIG. 1 discloses a dispensing apparatus 10 which includes a lower base cabinet 11 connected to a front cabinet 12 which, in turn, is disposed beneath in support a middle cabinet shown at 13. The middle cabinet 13 may also include a scale or weighing function (not shown). Any one of the cabinets 11 through 13 may house a controller 14 (not shown in FIG. 1; see FIGS. 4-5) and other electronic equipment. The cabinet 11 supports an upper cabinet 15 which, in turn, houses a plurality of modules which are represented by pairs of canisters shown generally at 16. In the example shown in FIG. 1, six modules in the upper cabinet 15 that each can dispense two different fluids are shown for a total dispensing of 12 different fluids. Additional modules may be disposed in the base cabinet 11.

FIG. 1 also illustrates a manifold module 17 which will be described below. The sequential or, preferably simultaneous dispensing of one or more fluids from the 12 or more difference fluids provided in FIG. 1 is made through the manifold module 17 and down into the container 18. A combination manifold and closure system is shown at 20. Brackets are shown at 21 for supporting pumps, motors and control boards (not shown).

Figure 2:
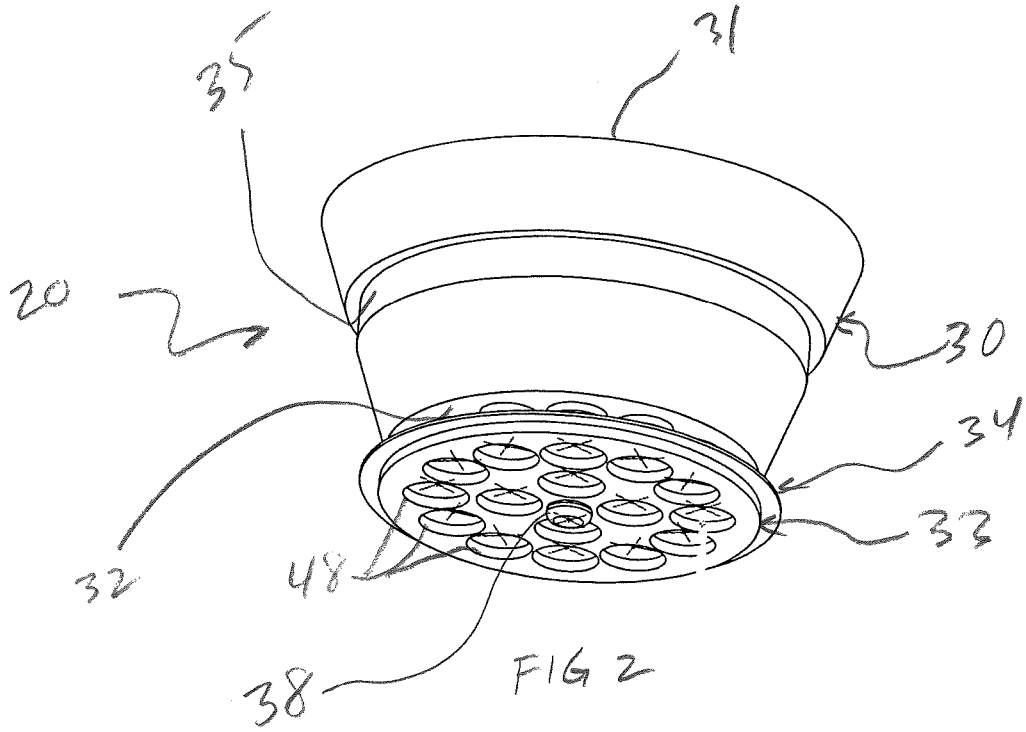
FIG. 2 is a perspective view of a disclosed combination nozzle block and closure system in a closed position.

Turning to FIG. 2, a manifold or nozzle block 30 is illustrated which has an essentially truncated conical shape. However, a cylindrical manifold 30 may also be employed as well as other shapes. The manifold 30 includes an inlet end 31 and an outlet end 32. Disposed below the outlet end 32 is a rigid plate 33. The plate 33 supports a film 34 which will be discussed in greater detail below. A mid portion of the manifold 30 includes a circumferential recess 35, which may be used to support the manifold 30 in the manifold module or cabinet 17.

Figure 3:
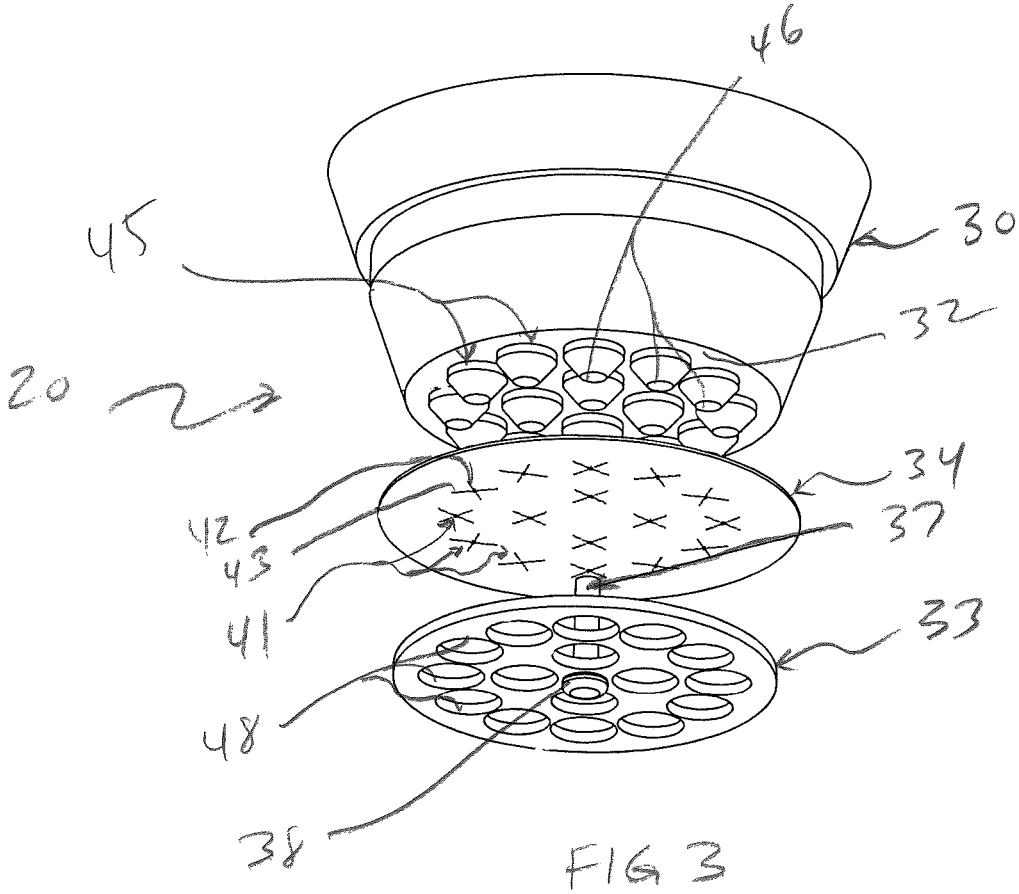
FIG. 3 is an exploded view of the combination manifold and nozzle closure system illustrated in FIG. 2.

Turning to FIG. 3, an exploded view of the manifold 30, film 34, plate 33 and actuator shaft 37. The actuator shaft 37 includes a distal end 38 that supports the plate 33. The shaft 37 also passes through the film 34 and manifold 30 as illustrated schematically in FIGS. 4-5.

Still referring to FIGS. 2-3, the film 34 illustrated includes a plurality of valves 41 that are shown as crosshatches or intersecting slits 42, 43. Other variations of the valves 41 disposed in the film 34 are illustrated in FIGS. 6-7 below.

FIGS. 2-3 also illustrate the nozzles 45 extending downward through the outlet end 32 of the manifold 30. Each nozzle 45 includes a bullet-shaped head with a nozzle outlet 46. When viscous, water-based materials are dispensed through nozzles like those shown at 45 in FIGS. 2-3, material can clog or dry and cake the interior sides of the nozzle outlets 46. As a result, the nozzles 45 may clog, pressure may buildup in the nozzle outlets 46 or material may cling or hang on to dried material leaving an undispensed drop that hangs on the nozzle 45. All of these effects can detrimentally effect the accuracy of the dispense. Hence, the disclosed closure mechanism that includes the plate 33, film 34 and actuator shaft 37 is intended to alleviate these problems. FIGS. 2-3 also illustrate the through openings 48 disposed in the plate 33. It will be noted from FIGS. 2-3 that the through openings 48 in the plate 33 are aligned with or are in matching registry with the valves 41 in the film 34. Still further, each through opening 48 is aligned with a valve 41 which, in turn, is also aligned with a nozzle outlet 46. FIG. 2 illustrates the closure mechanism in a closed position with the plate 33 and film 34 disposed just below the nozzle outlets and, as illustrated in FIG. 4, the film 34 engages the nozzle outlets.

Figure 4:
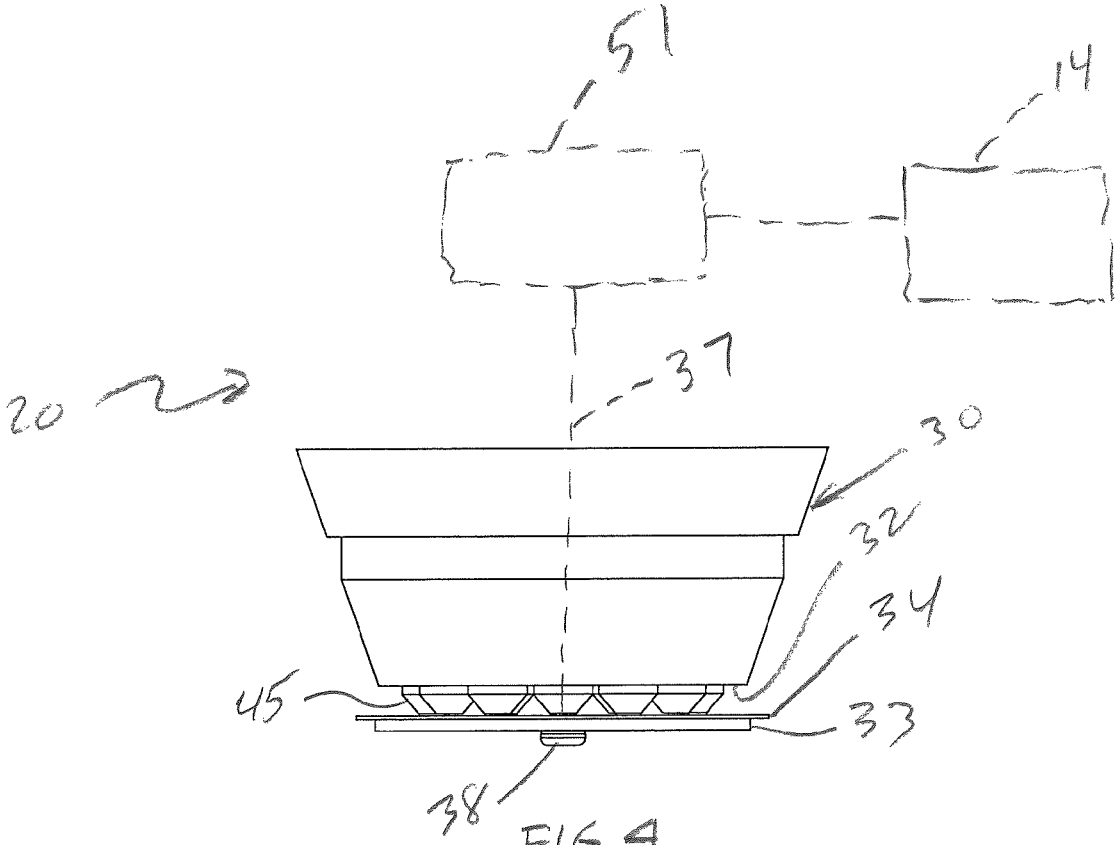
FIG. 4 is a plan view of the combination manifold and nozzle closure system illustrated in FIGS. 2-3 in a closed position and showing the linkage to an actuator and controller.
Figure 5:
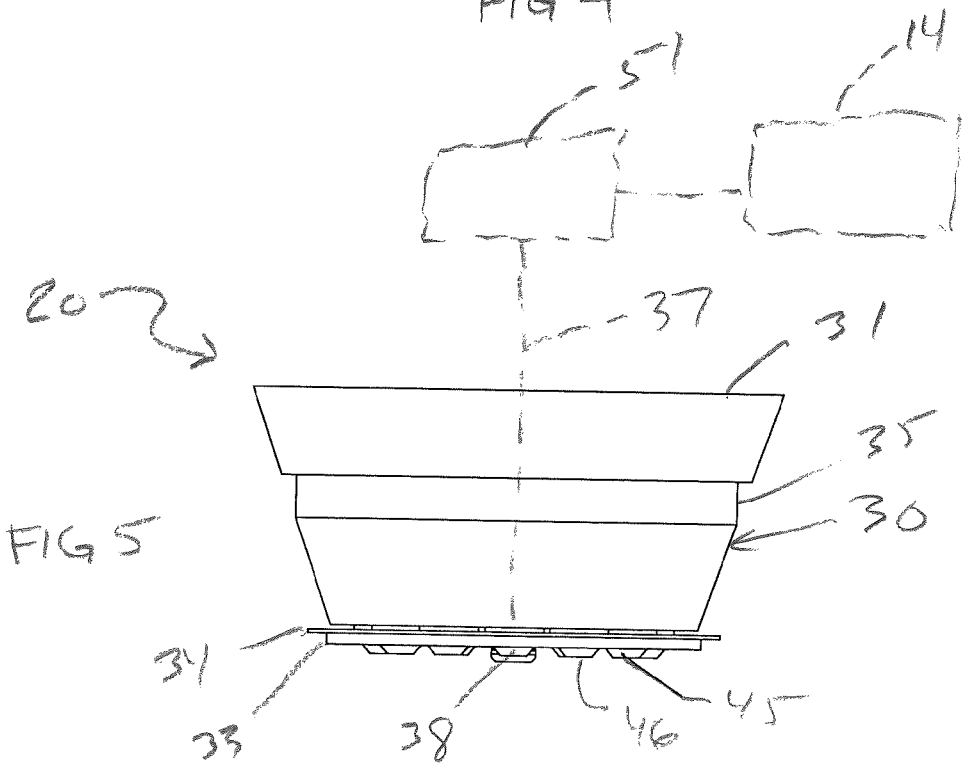
FIG. 5 is a plan view of the combination manifold and nozzle closure system illustrated in FIG. 4, in an open or dispense position.

Turning to FIGS. 4-5, a comparison of the closure system in a closed position (FIG. 4) and an open position (FIG. 5) is provided. In FIG. 4, the actuator shaft 37 has been lowered by the actuator 51 so that the plate 33 is disposed below the nozzles 45 and the film 34 is engaging the nozzle outlets 46. In the position shown in FIG. 4, the valves 41 of the film 34 are closed, thereby providing a seal or closure for each nozzle outlet 46. In contrast, in FIG. 5, the actuator shaft 37 has been raised by the actuator 51 thereby pulling the film 34 and plate 33 upwards towards the outlet end 32 of the manifold 30. The valves 41 of the film engage the nozzle outlets 46 and nozzles 46, thereby forcefully opening the valves 41 and the through openings of plate 33 proceed over the nozzles 45. Position shown in FIG. 5, the nozzle outlets 46 have been forced past the valves 41 of the film 34 and through the openings 48 of the plate 33 thereby providing the outlets 46 with clearance for a downward dispense. Actuator 51 may be controlled by a controller 14, which may be central to the operation of the entire dispenser 10, or an individual module of the entire dispensing system 10. The exemplary manifold block 30 illustrated in FIGS. 2-5, only 16 nozzles 45 extend through the manifold 30. Obviously, more or less than 16 nozzles 45 may be employed and, in many paint dispensing systems, for example, 28 nozzles extend through a single manifold. The actuator 51 may be motorized, hydraulic or mechanical or part of a gear system linked to the dispensing pumps.

Figure 6:
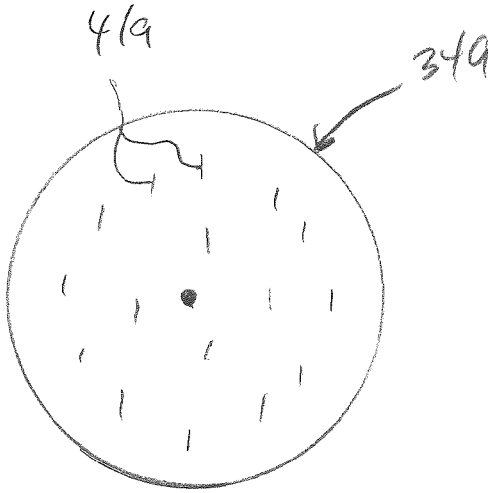
FIG. 6 is a plan view of a film made in accordance with this disclosure illustrating valves that are small slits as opposed to the crossing slits illustrated in FIGS. 2-3.
Figure 7:
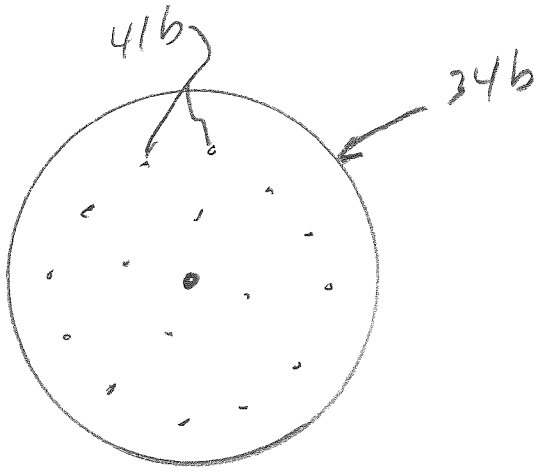
FIG. 7 is another plan view of a disclosed film wherein the valves are small holes in the film as opposed to the slits illustrated in FIGS. 2-3 and 6.

Alternative films 34*a* and 34*b* are illustrated in FIGS. 6-7. In FIG. 6, the film 34*a* includes valves 41*a* that are single slits as opposed to the cross-hatched slits 42, 43 illustrated in FIGS. 2-3. In FIG. 7, the film 34*b* includes valves 41*b* are small holes or pinholes that are stretched open when the actuator shaft 37 pulls the plate 33 and film 34*b* over the nozzles 45 as illustrated in FIG. 5.

Figure 8:
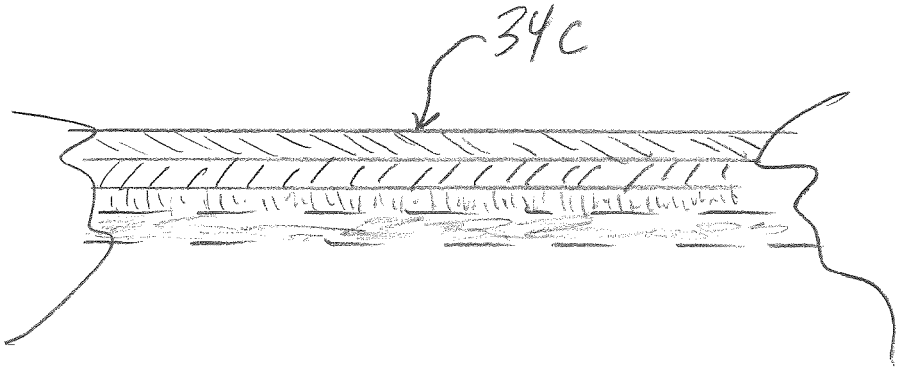
FIG. 8 is a partial sectional view of a multiple layer film made in accordance with this disclosure.

FIG. 8 illustrates yet another film 34*c* that may include multiple layers. The film 34*c* may include two, three, four or more layers, depending upon the materials chosen for construction. The plate 33 is preferably rigid and may be fabricated from a rigid plastic material, or may be metallic. Similarly, the rod 37 may be a rigid plastic piece or metallic. Various polymers and acrylic materials may be used to fabricate the manifold 30.

While only certain embodiments have been set forth, alternatives and modifications will be apparent from the above description to those skilled in the art. These and other alternatives are considered equivalents and within the spirit and scope of this disclosure and the appended claims.

The invention claimed is:

1. A combination manifold for accommodating a plurality of nozzles and a closure system for limiting exposure of the nozzles to air between uses, the combination comprising:

a manifold comprising an inlet end and an outlet end and a plurality of through openings extending between the inlet and outlet ends, the through openings accommodating a plurality of nozzles, each nozzle comprising a nozzle outlet extending beyond the outlet end of the manifold, an actuator shaft comprising a proximal end connected to an actuator and a distal end connected to a plate, the plate being coupled to a film disposed between the plate and the nozzle outlets, the actuator shaft passing through a common axis of the plate, film and manifold, the plate comprising a plurality of through openings, each opening being in matching registry with one of the nozzles, the film comprising a plurality of valves, each valve being in matching registry with one of the nozzles.

2. The combination of claim 1 wherein the valves in the film are slits.

3. The combination of claim 1 wherein the valves in the film are small holes that expand and stretch over the nozzle outlets when the actuator moves the plate and film upward over the nozzle outlets.

4. The combination of claim 1 wherein the film comprises a material selected from the group consisting of polyurethanes, polytetrafluoroethylene, modified polytetrafluoroethylene, ethylene-propylene copolymers, ethylene-propylene terpolymers, silicone elastomers, polyoxymethylenes, polyacetyls, polyamides, polyethylenes, polypropylenes, nitrile rubbers, tetrafluoroethylene-propylene rubbers, hydrogenated nitrile butadiene rubbers and combinations thereof.

5. The combination of claim 1 wherein the film comprises multiple layers.

6. The combination of claim 4 wherein the film comprises multiple layers.

7. The combination of claim 1 wherein the actuator moves the actuator shaft from an open position, wherein the film is sandwiched between the plate and the outlet end of the manifold with the nozzle outlets extending at least partially through the valves of the film and at least partially through openings of the plate, to a closed position, wherein the plate and film are moved away from the outlet end of the manifold so the valves of the film close and engage the nozzle outlets.

8. The combination of claim 1 wherein the plate is rigid and the film is flexible.

9. The dispenser of claim 1 wherein the plate is metallic and the film is polymeric.

10. A combination manifold for accommodating a plurality of nozzles and a closure system for limiting exposure of the nozzles to air between uses, the combination comprising:

a manifold comprising an inlet end and an outlet end and a plurality of through openings extending between the inlet and outlet ends, the through openings accommodating a plurality of nozzles, each nozzle comprising a nozzle outlet extending beyond the outlet end of the manifold, an actuator shaft comprising a proximal end connected to an actuator and a distal end connected to a plate, the plate being coupled to a film disposed between the plate and the nozzle outlets, the plate comprising a plurality of through openings, each opening being in matching registry with one of the nozzles, the film comprising a plurality of valves, each valve being in matching registry with one of the nozzles, and wherein the valves are small holes that expand and stretch over the nozzle outlets when the actuator moves the plate and film upward over the nozzle outlets.

11. A combination manifold for accommodating a plurality of nozzles and a closure system for limiting exposure of the nozzles to air between uses, the combination comprising:

a manifold comprising an inlet end and an outlet end and a plurality of through openings extending between the inlet and outlet ends, the through openings accommodating a plurality of nozzles, each nozzle comprising a nozzle outlet extending beyond the outlet end of the manifold, an actuator shaft comprising a proximal end connected to an actuator and a distal end connected to a plate being coupled to a film disposed between the plate and the nozzle outlets, wherein the actuator moves the actuator shaft from an open position, wherein the film is sandwiched between the plate and the outlet end of the manifold with the nozzle outlets extending at least partially through the valves of the film and at least partially through openings of the plate, to a closed position, wherein the plate and film are moved away from the outlet end of the manifold so the valves of the film close and engage the nozzle outlets, the plate comprising a plurality of through openings, each opening being in matching registry with one of the nozzles, the film comprising a plurality of valves, each valve being in matching registry with one of the nozzles.

* * * * *